US005931766A

United States Patent [19]

Cooper

[11] Patent Number: 5,931,766

[45] Date of Patent: Aug. 3, 1999

[54] COMBINATION JUMPING GAME AND EXERCISER

[76] Inventor: Steve E Cooper, 1355 Pipkin St., Beaumont, Tex. 77705

[21] Appl. No.: 08/999,500

[22] Filed: Dec. 29, 1997

[51] Int. Cl.[6] ..... A63B 5/00

[52] U.S. Cl. ..... 482/81; 446/247

[58] Field of Search ..... 482/81, 82; 446/236–241, 446/247–249

[56] References Cited

U.S. PATENT DOCUMENTS 4,813,665 3/1989 Carr ..... 482/3
4,875,675 10/1989 Arad et al. ..... 482/81

*Primary Examiner*—Glenn E. Richman
*Attorney, Agent, or Firm*—Michael I. Kroll

[57] ABSTRACT

A combination jumping game and exerciser providing at least one player with both a physical and cardiovascular workout. The combination jumping game and exerciser includes a base having a face side and defining at least two playing zones. A motor is positioned within the base and includes a rotating shaft. A rotating plate is positioned on the face side of the base and is connected to rotate with the motor shaft. A rod is connected to and extends from the rotating plate for rotating about the base. In operation the rod passes through the at least two playing zones during rotation and ceases its rotation upon contacting an object in its path of rotation. As the rod rotates players are positioned within respective ones of the at least two playing zones and leap over the rod as it passes through their zone. If a player contacts the rod as it passes through their zone, the rod ceases its rotation and the player receives a strike. The last player left striking the rod fewer than the maximum number of times wins the game. The game is also provided with a speed control to adjust the speed at which the rod rotates and a scoreboard for tracking the number of times each player contacts the rod. A counter is also provided for tracking the number of rotations completed by the rod.

6 Claims, 4 Drawing Sheets

COMBINATION JUMPING GAME AND EXERCISER

BACKGROUND OF THE INVENTION

1. Field of the Invention

The present invention relates generally to exercise games and devices and, more specifically, to a combination jumping game and exerciser which allows users to exercise together in a competitive game based upon individual abilities while providing both a physical and cardiovascular workout.

2. Description of the Prior Art

Numerous exercise games and devices have been provided in the prior art. For example, U.S. Pat. Nos. 4,059,271; 5,244,206 and 5,451,192 are all illustrative of such prior art. While these units may be suitable for the particular purpose to which they address, they would not be as suitable for the purposes of the present invention as heretofore described.

U.S. Pat. No. 4,059,271

Inventor: Dupre

Issued: November 1977

A hip mounted tethered ball game including a bracket attached to the hip region of a person. A line is attached at one end to the bracket. A ball is tethered to the opposite end of the line in free swinging fashion. The object of the game is to rotate the tethered ball in vertical circles about its attachment to the bracket by utilizing hip movement.

U.S. Pat. No. 5,244,206

Inventor: Kerwin E. Clark et al.

Issued: Sep. 14, 1993

A hip mounted polo-like game suitable for both indoor and outdoor activity including a belt for placement about the hips of a player. A playing ball is free to move on a playing surface. A tethered ball is attached to the belt so that movement of the players hips will cause the tethered ball to move relative to the playing surface for purpose of striking the playing ball toward a goal.

U.S. Pat. No. 5,451,192

Inventor: Sheryn B. Hefele

Issued: Sep. 19, 1995

An adjustable exercise device is provided for a child, which consists of a stationary support stand to be positioned on a flat surface. A handlebar assembly is mounted on the stationary support stand. A mechanism for simulation stepping motion is mounted to the stationary support stand. A child can grip the handlebar assembly with hands and place the feet on the simulation stepping motion mechanism, so as to exercise by manually activating the simulation stepping motion mechanism.

SUMMARY OF THE PRESENT INVENTION

The present invention relates generally to exercise games and devices and, more specifically, to a combination jumping game and exerciser which allows users to exercise together in a competitive game based upon individual abilities while providing both a physical and cardiovascular workout.

A primary object of the present invention is to provide a combination jumping game and exerciser that will overcome the shortcomings of prior art devices.

Another object of the present invention is to provide a combination jumping game and exerciser which is able to provide both a physical and cardiovascular workout for an individual.

An additional object of the present invention is to provide a combination jumping game and exerciser including a rotating bar over which the players must jump as it rotates through their designated area.

A still further object of the present invention is to provide a combination jumping game and exerciser that is able to track the number of times a user was unable to leap over the rotating bar.

An even further object of the present invention is to provide a combination jumping game and exerciser in which the rotating bar will cease movement upon contacting a player.

A still further object of the present invention is to provide a combination jumping game and exerciser including a delay period and alarm for preparing players for the bar to begin rotating through the playing area.

A yet further object of the present invention is to provide a combination jumping game and exerciser wherein the speed at which the bar rotates is adjustable.

Another object of the present invention is to provide a combination jumping game and exerciser that is simple and easy to use.

A still further object of the present invention is to provide a combination jumping game and exerciser that is economical in cost to manufacture.

Additional objects of the present invention will appear as the description proceeds.

A combination jumping game and exerciser providing at least one player with both a physical and cardiovascular workout is described by the present invention. The combination jumping game and exerciser includes a base having a face side and defining at least two playing zones. A motor is positioned within the base and includes a rotating shaft. A rotating plate is positioned on the face side of the base and is connected to rotate with the motor shaft. A rod is connected to and extends from the rotating plate for rotating about the base. In operation the rod passes through the at least two playing zones during rotation and ceases its rotation upon contacting an object in its path of rotation. As the rod rotates players are positioned within respective ones of the at least two playing zones and leap over the rod as it passes through their zone. If a player contacts the rod as it passes through their zone, the rod ceases its rotation and the player receives a strike. The last player left striking the rod fewer than the maximum number of times wins the game. The game is also provided with a speed control to adjust the speed at which the rod rotates and a scoreboard for tracking the number of times each player contacts the rod. A counter is also provided for tracking the number of rotations completed by the rod.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

Figure 4:
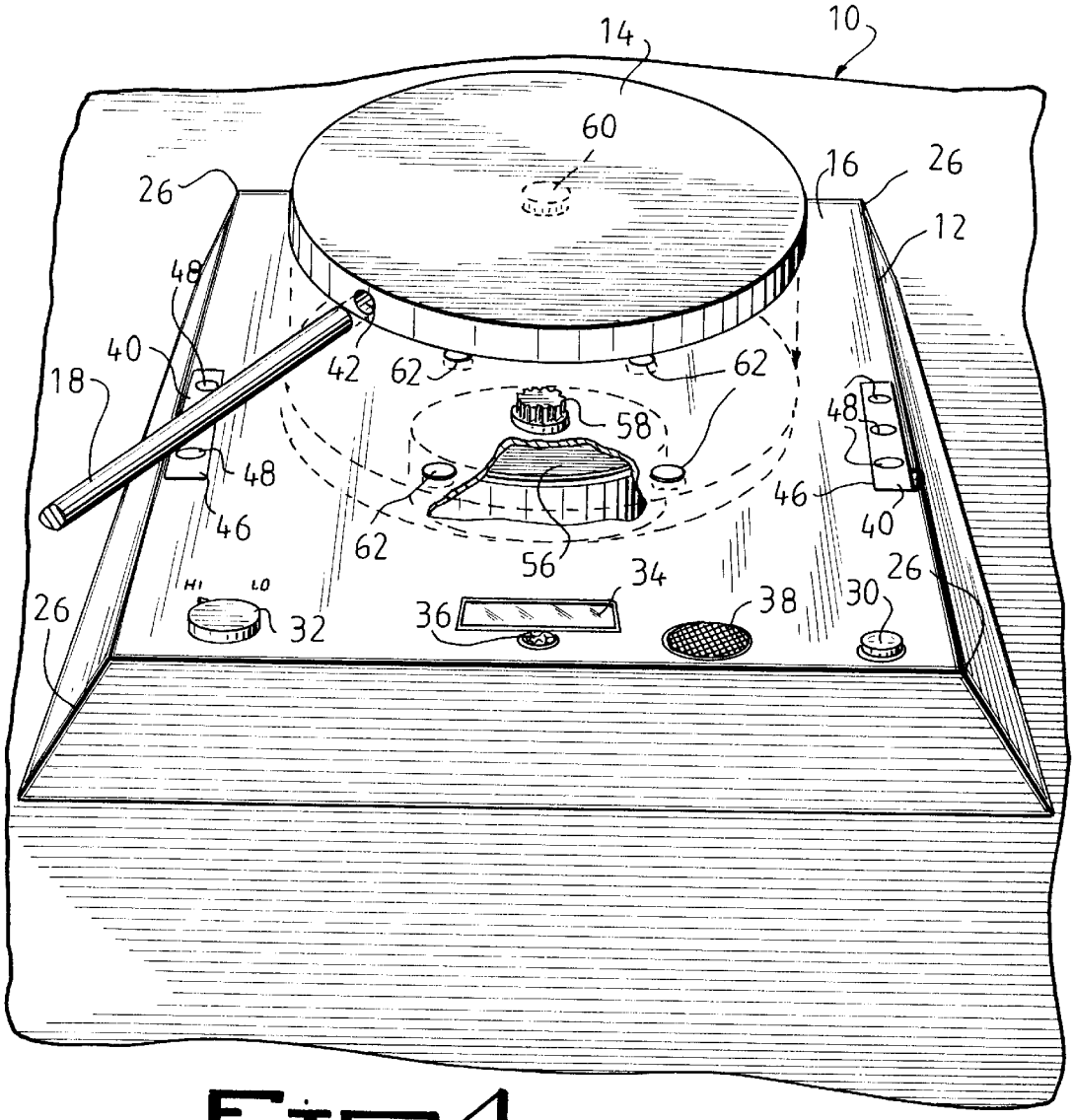
Figure 5:
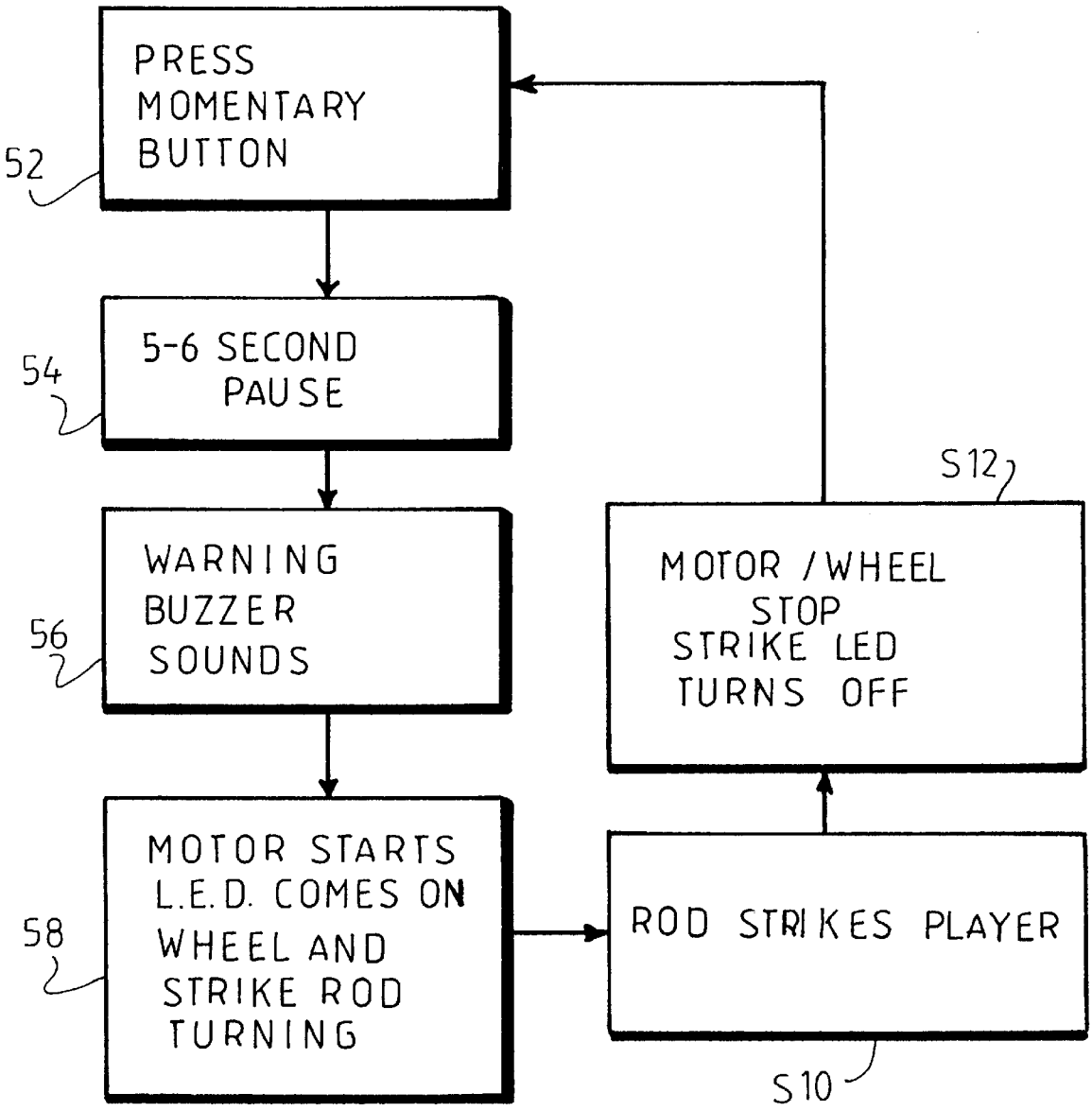

FIG. 4 a top exploded perspective view with parts cut away of the combination jumping game and exerciser of the present invention; and FIG. 5 is a flow chart illustrating the operating process of the combination jumping game and exerciser of the present invention.

DESCRIPTION OF THE REFERENCED NUMERALS

Turning now descriptively to the drawings, in which similar reference characters denote similar elements throughout the several views, the Figures illustrate the combination jumping game and exerciser of the present invention. With regard to the reference numerals used, the following numbering is used throughout the various drawing figures.

10 combination jumping game and exerciser of the present invention
12 base
14 revolving central wheel
16 top side of base
18 rod connected to revolving central wheel
20 playing zone
22 starting zone
24 diagonal lines defining playing and starting zones
26 corners of base
28 players
30 start button
32 speed control dial
34 counter
36 strike light
38 warning starting buzzer
40 scoreboards
42 insertion point in rotating wheel for rod
44 recess extending into rotating wheel
46 cover strip
48 holes within cover strip
50 knob
52 marking strip
54 hand of person moving knob
56 motor
58 motor shaft
60 recess on underside of rotating wheel
62 position sensors

DETAILED DESCRIPTION OF THE PREFERRED EMBODIMENT

Turning now descriptively to the drawings, in which similar reference characters denote similar elements throughout the several views, FIGS. 1 through 4 illustrate the combination jumping game and exerciser of the present invention indicated generally by the numeral 10.

Figure 1:
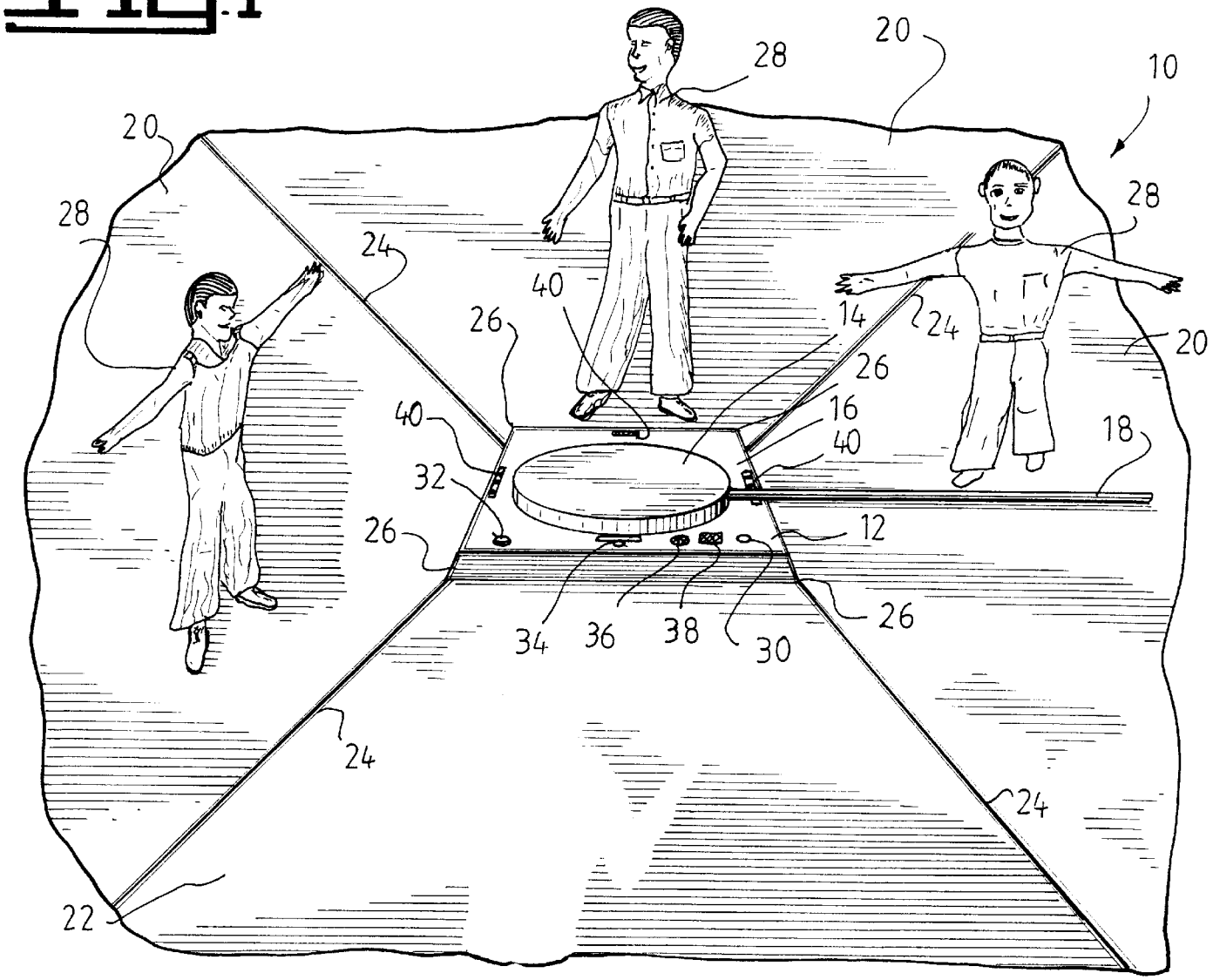
FIG. 1 is a top perspective view of the combination jumping game and exerciser of the present invention in operation with three players.

The combination jumping game and exerciser 10 is illustrated in FIG. 1 and includes a base 12 and a rotating plate 14 positioned on a top side 16 of the base 12. The base 12 is preferably pyramidal in shape including four sides of equal length with the top side 16 being flat. The preferred length of each side is 12 inches by 12 inches although the sides may be any length desired. Connected to and extending from the rotating plate 14 is a rod 18. The rod 18 extends past the sides of the base and is preferably 3–4 feet in length with a diameter of ¼inch. The rod 18 is connected to rotate with the rotating plate 14.

Three individual playing zones 20 and one starting zone 22 are defined by diagonal lines 24 being drawn from each corner 26 of the base 12. One player 28 is positioned within each player zone 20 and the starting zone 22 remains unoccupied when the combination jumping game and exerciser 10 is being played. When each round of the combination jumping game and exerciser 10 is started the rod 18 is positioned to extend into the starting zone 22.

Figure 3:
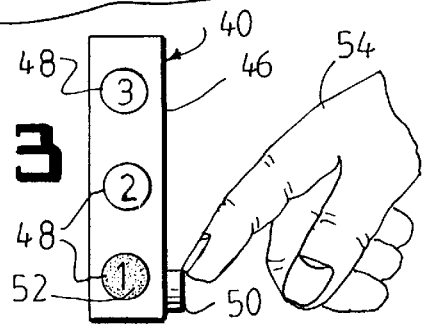
FIG. 3 is a top view of the scoreboard of the combination jumping game and exerciser of the present invention.

Positioned on the face side 16 of the base 12 is a start button 30 for starting the rotation of both the rotating plate 14 and the rod 18. A variable speed control 32 is also positioned on the face side 16 for manually controlling the speed at which the rotating plate 14 and rod 18 turn. A counter 34 is positioned on the face side 16 and within the area for the start zone 24 for counting the number of rotations made by the rod 18. A strike fight 36 and warning stating buzzer 38 are positioned adjacent the counter 34. The strike light 36 provides a visual indication of the rod 18 contacting a player 28 as it rotates about the playing areas. The strike light 36 will preferably turn on when the rod 18 begins turning and will turn off upon the rod 18 striking or contacting a player 28. However, the alternate may occur in which the strike light 36 remains off until the rod 18 strikes or contacts a player 28. The warning starting buzzer 38 provides an audio indication that either a new round is starting and the rod 18 will begin to rotate or that the rod 18 has struck a player 28 and the round is now over. Positioned on the face side 16 and in front of each playing zone 20 is a scoreboard 40 for tracking how many times the rod 18 has struck the player 28 in the respective playing zone 20 during the game. The scoreboards 40 may be either manually or electrically controlled, a manual scoreboard is illustrated in FIG. 3 and will be described in detail hereinafter.

Figure 2:
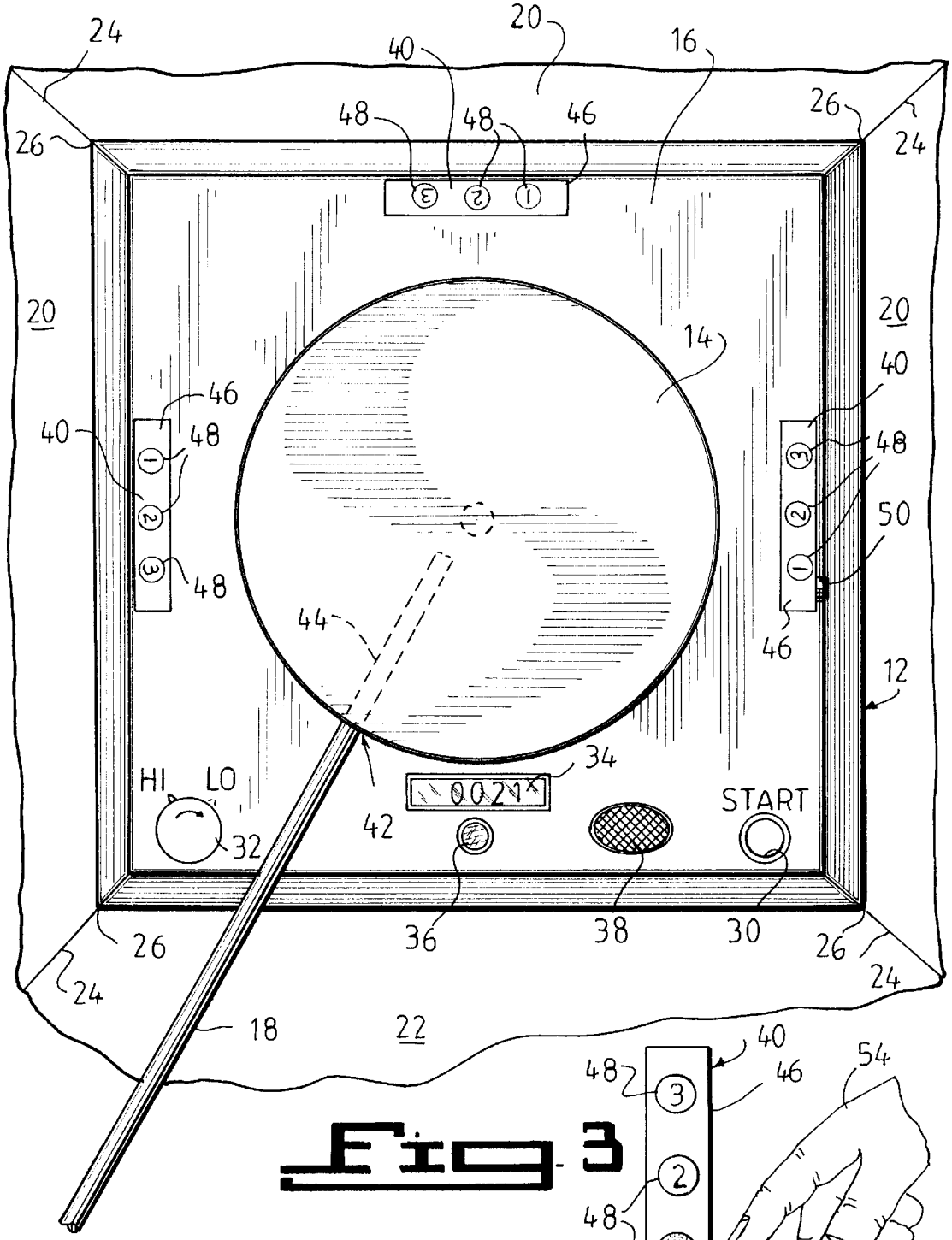
FIG. 2 is a top view of the combination jumping game and exerciser of the present invention.

A top view of the combination jumping game and exerciser 10 illustrating the face side 16 is shown in FIG. 2. As can be seen from this figure, the rod 18 is inserted into the rotating plate 14 at an insertion point 42 and extends into a recess 44, shown in dashed lines, extending within and towards the center of the rotating plate 14. As is more clearly seen from this view, a scoreboard 40 is positioned in front of each playing zone 20. The scoreboards 40 illustrated are manually operated and as is also seen in FIG. 3 include a cover strip 46 having a number of holes 48 cut therein. A number is visible through each hole 48 for use in scoring. A handle or knob 50 extends from below the cover strip 46. A space is provided between the cover strip 46 and the face side 16 within which is seated a marking device 52. The marking device 52 is connected to the knob 50 and movable within the space under the control of the knob 50. As the marking device 52 is moved along the length of the space, it slides below and is viewable within one of the respective holes 48 cut into the respective cover strip 46. The hole 48 through which the marking strip 52 is visible indicates the number of times the player 28 within the respective playing area 20 has been struck by the rod 18. FIG. 3 illustrates the movement of the knob 50 and marking strip 52 under the control of a person's hand 54. Alternatively, the scoreboard 40 can be electrically controlled and in the form of a plurality of LED's or even a digital scoreboard.

An exploded view of the combination jumping game and exerciser 10 is illustrated in FIG. 4. This figure illustrates a motor 56 positioned within the base 12 and a motor shaft 58 extending through the base 12 and engaging an underside of the rotating plate 14. The motor shaft 58 fits into a recess 60 on the underside of the rotating plate 14 for rotating the plate 14 under the control of the motor 56. The speed at which the motor shaft 58 turns the rotating plate 14 is controlled by the variable speed control 32 which is connected to the motor 56. Also positioned on the face side 16 and covered by the rotating plate 14 are a plurality of position sensors 62. The position sensors 62 determine the position of the rod 18 and track the rotation of the rod 18 as it turns with the rotating plate 14.

The operation of the combination jumping game and exerciser 10 will now be described with reference to the figures and specifically to the flow chart of FIG. 6. In operation, the combination jumping game and exerciser 10 is positioned on a flat surface and the playing zones 20 and starting zone 22 are set by drawing diagonal lines 24 extending from the corners of the base 12. The rod 18 is placed to extend from the recess 44 within the rotating plate 14 and positioned to extend into the starting zone 22. The variable speed control 32 is now set so that the rod 18 will rotate at a desired speed. The players 28 then position themselves within a respective playing zone 20 and the game is ready to be started.

One player 28 then presses the start/momentary button 32 as is described in step S2. There is then a short pause prior to the game starting providing the players time to get ready as stated in step S4. The pause is normally about 5–6 seconds however longer or shorter pauses may be set to provide an adequate time for all players to get ready. The warning buzzer 38 now sounds to announce the impending start of the rotation of the rod 18 and rotating plate 14 as discussed in step S6.

The motor 56 now starts and the strike LED 36 turns on. The starting of the motor 56 causes the motor shaft 58 to turn. The turning of the motor shaft 58 turns the rotating plate 14 and the rod 18 as described in step S8. The rod 18 begins to rotate passing through each playing zone 20 as each player 28 jumps over the rod 18. The rod 18 continues to rotate around the base 12 until it strikes a player 28 as stated in step S10. At this point, the pressure applied to the rod 18 by striking the player 28 causes the motor 56, motor shaft 58, rotating plate 14 and thus the rod 18 to stop turning. The strike light 36 then turns off as described in step S12 and the player 28 struck by the rod 18 adjusts the manually operated scoreboard to indicate the number of times struck by the rod 18. If the scoreboard 40 is electrical and automatically operated, the score is automatically adjusted based upon the sensing of the rod 18 string a player and the determination by the position sensors 62 indicating which zone 20 the rod 18 extends into upon cessation of rotation. The game 10 is now continued by pressing the start/momentary button 32. The steps are repeated from the beginning until one player 28 is left without being hit by the rod 18 a predetermined number of times.

From the above description it can be seen that the combination jumping game and exerciser of the present invention is able to overcome the shortcomings of prior art devices by providing a combination jumping game and exerciser which is able to provide both a physical and cardiovascular workout for an individual playing the game. The combination jumping game and exerciser includes a rotating bar over which the players must jump as it rotates through their designated area, a delay period and alarm for preparing players for the bar to begin rotating through the playing area and a scoreboard for tracking the number of times a user was unable to leap over the rotating bar. The speed of rotation of the bar is adjustable and the rod will cease movement upon contacting a player. Furthermore, the combination jumping game and exerciser of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A combination jumping game and exercise for multiple players comprising:

a) a base having a face side and a plurality of visually demarcated playing zones and a starting zone surrounding said base, one player occupying each playing zone, and said starting zone unoccupied by a player;

b) a motor positioned within the base including a rotating shaft;

c) a rotating plate positioned on said face side and connected to rotate with said motor shaft;

d) a rod connected to and extending from said rotating plate for rotating about said base with said rotating plate and said motor shaft, said rod passing through said starting and playing zones during rotation, said rod starting rotation at the beginning of the game from said starting zone;

e) means for selecting the speed of said plate and rod and starting rotation of said plate and rod;

f) means for initiating a delay prior to beginning rotation of said rod and issuing an audible alarm prior to beginning rotation so as to give notice to the players;

g) means for turning on a light and ceasing rotation of said plate and rod each time said rod hits a player:

h) means comprising a scoreboard located for each player in the player's playing zone for recording each time a player is hit by said rod and resuming rotation of said plate and rod, the winner of the game being the player remaining without being hit by said rod a predetermined number of times.

2. The combination jumping game and exerciser as recited in claim 1, further comprising a counter for counting a number of times said rod rotates about said base.

3. The combination jumping game and exerciser as recited in claim 2, further comprising a plurality of position sensors for determining a position of said rod both as it rotates about said base and upon cessation of movement of said rod.

4. A method of playing a combination jumping game and exerciser involving two or more players in competition with each other, comprising the steps of:

a) positioning players such that each player is in a visually demarcated separate playing zone, the playing zones being arranged around a rotatable plate along the path of rotation of a rod which extends from said plate, said plate being mounted on a base containing motor means to rotate said plate and rod;

b) initially positioning said rod to extend into a visually demarcated starting zone unoccupied by a player;

c) selecting the speed of rotation of said plate and rod;

d) pressing a start button to begin rotation of said plate and rod after a predetermined period of delay followed by an audible alarm prior to beginning of rotation to give notice to the players;

e) each player leaping over the rod as the latter passes through the playing zone occupied by said player;

f) actuating a light and stopping rotation of the rod each time a player is hit by said rod;

g) adjusting a scoreboard located for each player in each player's playing zone to indicate which player is hit by said rod;

h) resuming rotation of said plate and rod; and i) continuing play until the one player remaining without being hit by said rod a predetermined number of times is declared the winner.

5. The method of playing a combination jumping game and exerciser as recited in claim 4, wherein an alarm signal is issued indicating the rod has struck a player.

6. The method of playing a combination jumping game and exerciser as recited in claim 5, further comprising the step of sensing a position of rotation of the rod upon ceasing rotation using position sensors positioned on the base.

* * * * *